US008240499B2

(12) United States Patent
Lu

(10) Patent No.: US 8,240,499 B2
(45) Date of Patent: Aug. 14, 2012

(54) TRASHCAN WITH HYDRAULIC LID DECELERATION

(76) Inventor: Huanbang Lu, Hacienda Heights, CA (US)

( * ) Notice: Subject to any disclaimer, the term of this patent is extended or adjusted under 35 U.S.C. 154(b) by 414 days.

(21) Appl. No.: 12/454,233

(22) Filed: May 14, 2009

(65) Prior Publication Data

US 2010/0084235 A1 Apr. 8, 2010

(30) Foreign Application Priority Data

Oct. 8, 2008 (CN) ..... 2008 2 0201712 U

(51) Int. Cl.
*B65D 43/26* (2006.01)

(52) U.S. Cl. ..... 220/264; 220/827; 220/263; 220/908

(58) Field of Classification Search ..... 220/262–264, 220/908, 827.828; 16/54, 58
See application file for complete search history.

(56) References Cited

U.S. PATENT DOCUMENTS

| | | | | |
|---|---|---|---|---|
| 6,837,393 | B1 * | 1/2005 | Kuo | 220/263 |
| 7,494,021 | B2 * | 2/2009 | Yang et al. | 220/264 |
| 7,597,210 | B2 * | 10/2009 | Lin | 220/262 |
| 7,922,024 | B2 * | 4/2011 | Yang et al. | 220/264 |

* cited by examiner

*Primary Examiner* — Robin Hylton
(74) *Attorney, Agent, or Firm* — Clement Cheng

(57) ABSTRACT

A trashcan has a hydraulic drop-deceleration mechanism including a can body, a lid, and a connection pole for push-open connection. The lid is connected to the connection pole at a top connection pole end. The connection pole is connected to the foot pedal via a lever at a bottom connection pole end. A hydraulic mechanism is for drop-deceleration. The hydraulic mechanism is connected to the connection pole by a connector. The hydraulic mechanism has a chamber filled with hydraulic fluid. The hydraulic mechanism has a gliding rod moving within the chamber. The gliding rod forms a tip at a gliding rod lower end. The mechanism has upper and lower fluid storage chambers. A piston is slidingly mounted in the hydraulic mechanism is biased in a lid open position by a spring.

20 Claims, 7 Drawing Sheets

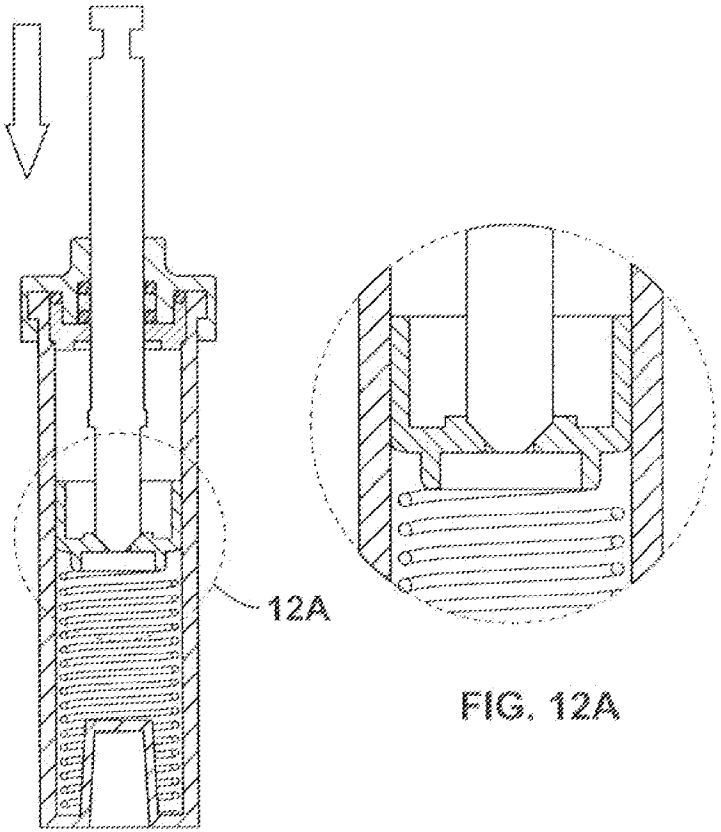
FIG. 12A
FIG. 12
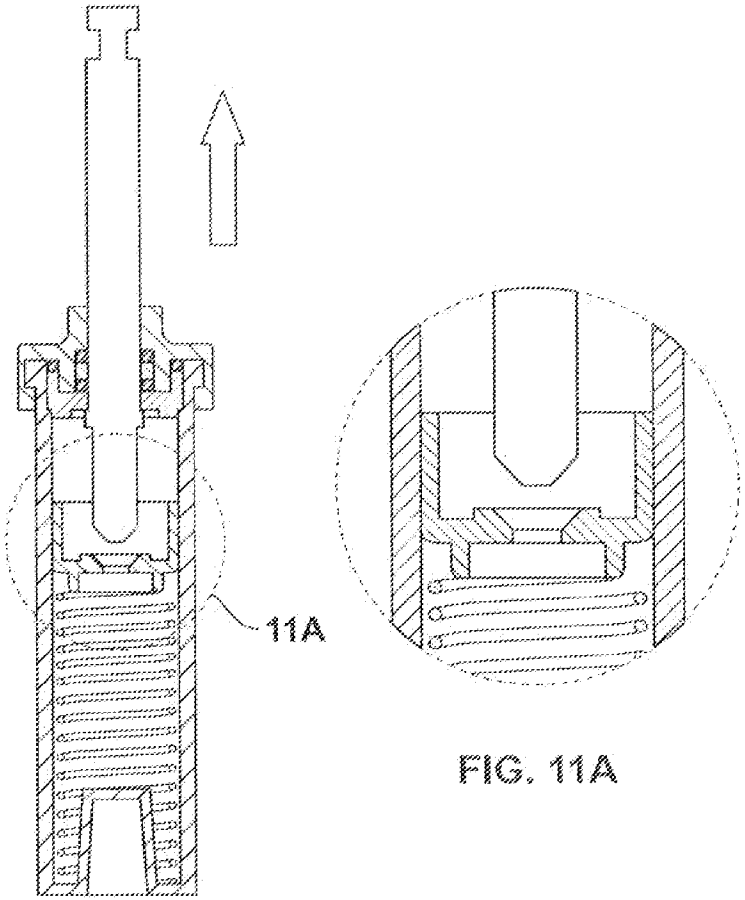
FIG. 11A
FIG. 11

TRASHCAN WITH HYDRAULIC LID DECELERATION

This application claims priority from Chinese patent application 200820201712.X filed Oct. 8, 2008, the disclosure of which is incorporated herein by reference.

FIELD OF TECHNOLOGY

This utility model involves one kind of trash can, in particular, one kind of trash can with a hydraulic drop-deceleration mechanism.

BACKGROUND TECHNOLOGY

A trash can is an indispensable item in our daily lives. To prevent unpleasant odors from spreading around and attracting rats, cockroaches, and flies, most trash cans are covered by a lid on the top open end with the lid hinged to the trash can. The lid is opened by stepping on an opening mechanism, by which: a foot peal is attached to the trash car; the foot pedal is connected to the lid through a push-open connection pole; when the foot pedal is stepped on, the push-open connection pole flips and opens the lid.

Presently, most of the trash can lids with the above-described construction are without a drop-deceleration mechanism. During operation, the disturbing noise of the lid hitting against the can is often produced when the lid closes which is an undesirable result. Although some trash can lids have a drop-deceleration mechanism, such mechanisms are complicated or not ideal for use. For example, a mechanism that employs a decelerating cable is not dependable; on the other hand, a mechanism that employs a hydraulic decelerator is not only complicated but leads to a comparatively slower lid-opening action which makes its use very inconvenient.

SUMMARY OF THE INVENTION

A trashcan has a hydraulic drop-deceleration mechanism including a can body, a lid, and a connection pole for push-open connection. The lid is connected to the connection pole at a top connection pole end. The connection pole is connected to the foot pedal via a lever at a bottom connection pole end. A hydraulic mechanism is for drop-deceleration. The hydraulic mechanism is connected to the connection pole by a connector. The hydraulic mechanism has a chamber filled with hydraulic fluid. The hydraulic mechanism has a gliding rod moving within the chamber. The gliding rod forms a tip at a gliding rod lower end. The mechanism has upper and lower fluid storage chambers. The piston slidingly mounted in the hydraulic mechanism is biased in a lid open position by a spring.

The tip seats on a fluid aperture on the piston in a closed position. When the gliding rod moves up, the tip is removed from the fluid aperture in an open position allowing hydraulic fluid to flow between the lower chamber and the upper chamber. When the gliding rod glides downward, the tip closes the fluid aperture, and slows hydraulic fluid flow between the lower chamber and the upper chamber.

To deal with the above mentioned issues, the purpose of this new utility model is to provide one kind of trash can with a hydraulic drop-deceleration mechanism that has a simple structure and is easy to use.

This is the technical scheme that is adopted by this utility model to resolve the issues: One kind of trash can with a hydraulic drop-deceleration mechanism, which includes: The can and the lid that is installed on top of the can. The lid is connected to the push-open connection pole at the top of the push-open mechanism. Said push-open connection pole is connected to the hydraulic drop-deceleration mechanism which is affixed to the can. The hydraulic drop-deceleration mechanism includes a cylinder and a gliding rod. The chamber of the cylinder is filled with hydraulic fluid. The tip of the gliding rod is housed inside the chamber of the cylinder. The other end of the gliding rod is connected to the push-open connection pole. Within the cylinder chamber is a piston which separates the chamber into an upper chamber and a lower fluid chamber. The bottom side of the piston comes in contact with the rebounding spring. A drop-deceleration flow-guiding mechanism is formed between the piston and the cylinder. Running through the piston is a rise-acceleration flow-guiding hole which corresponds to the tip of the gliding rod. When the gliding rod moves up, the upward movement of the piston is slower than that of the gliding rod. When the rise-acceleration flow-guiding hole opens up, the hydraulic fluid in the upper chamber flows rapidly into the lower chamber. When the gliding rod goes downward, the gliding rod pushes the piston seal down along with it, the tip of the gliding rod closes the rise-acceleration flow-guiding hole, and the hydraulic fluid in the lower chamber flows slowly into the upper chamber through the drop-deceleration flow-guiding mechanism that is formed by the piston seal and the cylinder.

The advantages of this new utility model are: Because the structure of the drop-deceleration mechanism of this trash can lid is simple, less force is required to open the lid. The opening speed is faster. When the lid is being closed, the closing is slower. No disturbing noise is produced. The operation is easy, dependable, and effective.

BRIEF DESCRIPTION OF THE DRAWINGS

This new utility model is further described with the following drawings.

FIG. 11 is a diagram of the preferred embodiment.

FIG. 11*a* is a diagram of the preferred embodiment.

FIG. 12 is a diagram of the preferred embodiment.

FIG. 12*a* is a diagram of the preferred embodiment.

Figure 1:
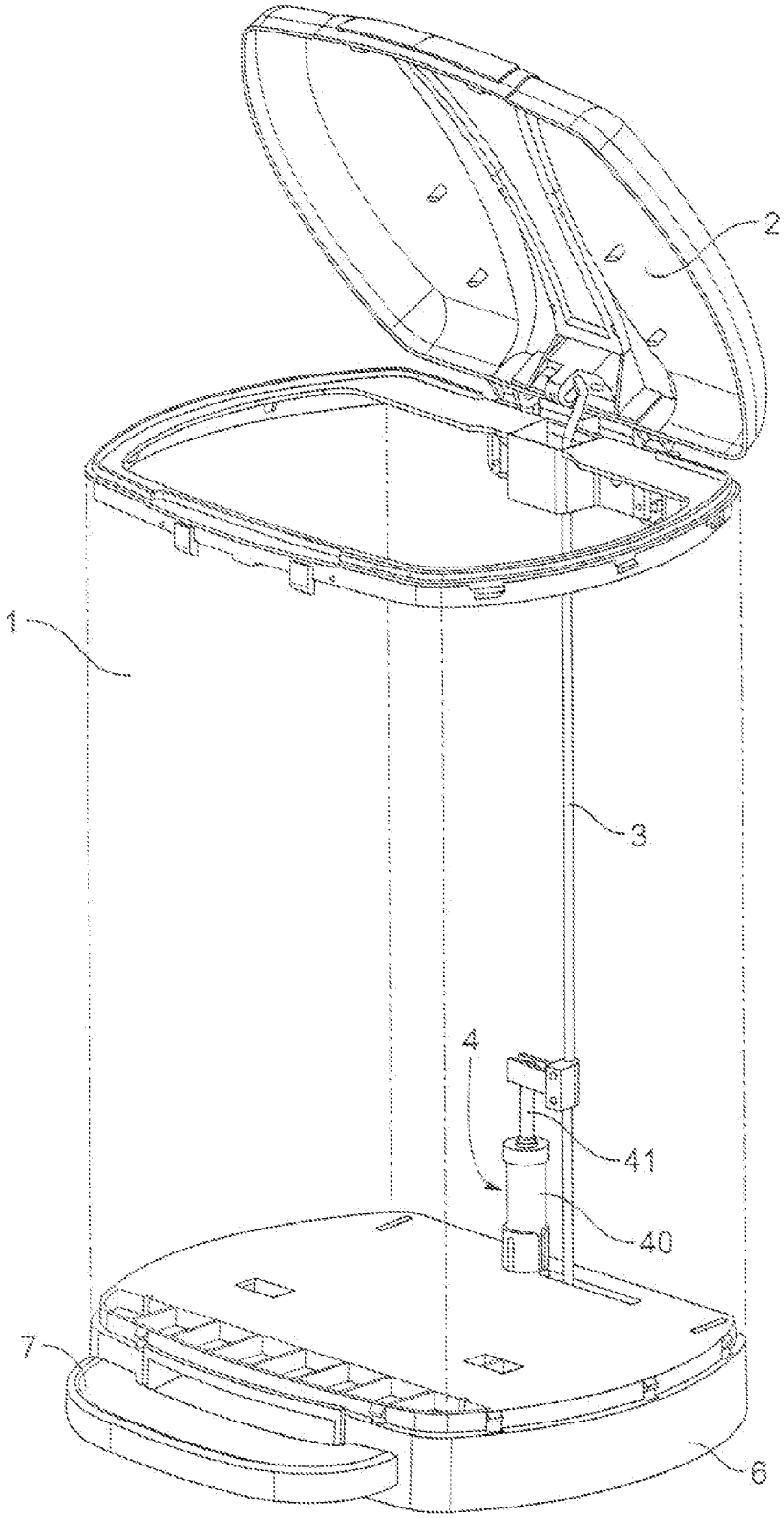
FIG. 1 is an illustration of the structure of this new utility model.
Figure 2:
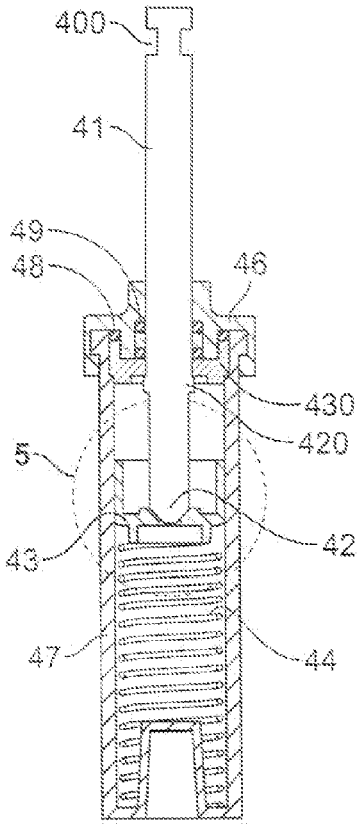
FIG. 2 is an illustration of the structure of the hydraulic drop-deceleration mechanism after the lid of this utility model is flipped.
Figure 3:
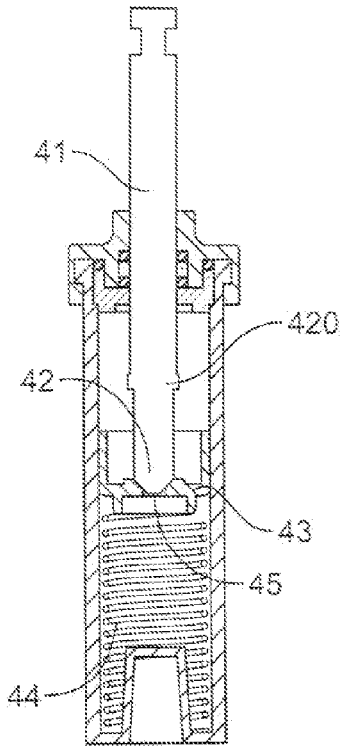
FIG. 3 is an illustration of the structure of the hydraulic drop-deceleration mechanism when the lid of this new utility model drops down.
Figure 4:
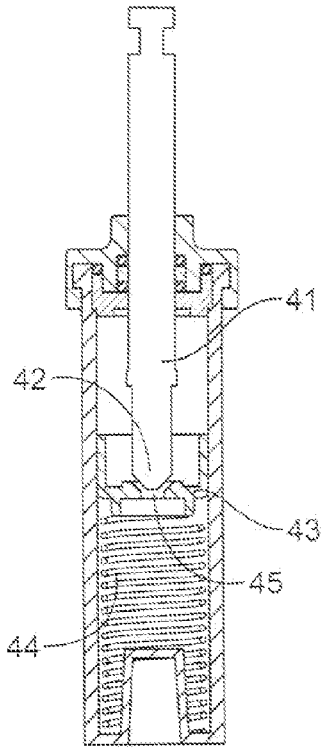
FIG. 4 is an illustration of the structure of the hydraulic drop-deceleration mechanism during the process of opening the lid of this utility model.

The following call out list of elements is provided for reference to the figures:

1 can lid
2 lid
3 push-open connection pole
4 hydraulic drop-deceleration mechanism
5 connector piece
6 base
7 foot pedal
8 holder
40 cylinder
41 gliding rod
42 tip
43 piston
44 rebounding spring
45 rise-acceleration flow-guiding hole
46 cylinder cap
47 cylinder body
48 gasket
49 gasket
50 locking groove
60 hydraulic mechanism housing
61 support rib
63 support abutment
64 hydraulic connection
65 parallel linkage
70 pivot axle
400 locking ring
420 rise-limitation stopper
430 limitation cushion

DETAILED DESCRIPTION OF THE PREFERRED EMBODIMENTS

Referring to FIGS. 1-7, this utility model, which is one kind of trash can with a hydraulic drop-deceleration mechanism, includes: The can 1 and the lid 2 that is installed on top of the can 1. The lid 2 is connected to the push-open connection pole 3 at the top of the push-open mechanism. The push-open mechanism includes a foot pedal 7 that is installed on the base 6 of the trash can. The foot pedal 7 is connected to the push-open connection pole 3. The push-open connection pole 3 could be a metal wire. Said push-open connection pole 3 is connected to the hydraulic drop-deceleration mechanism 4. The hydraulic drop-deceleration mechanism is anchored to the base 6 of the can 1 by the holder 8. The hydraulic drop-deceleration mechanism includes the cylinder 40 and the gliding rod 41. The chamber of the cylinder 40 is filled with hydraulic fluid. The tip 42 of the gliding rod 41 is housed within the chamber of the cylinder 40; the other end [of the gliding rod] is connected to the push-open connection pole 3. A piston seal 43, which separates the chamber into the upper chamber and the lower fluid chamber, is housed within the chamber of the cylinder 40. The bottom side of the piston seal 43 comes in contact with the rebounding spring 44. A drop-deceleration flow-guiding mechanism is formed between the piston seal 43 and the cylinder. Running through the piston seal 43 is a rise-acceleration flow-guiding hole 45 which corresponds to the tip 42 of the gliding rod 41.

Figure 5:
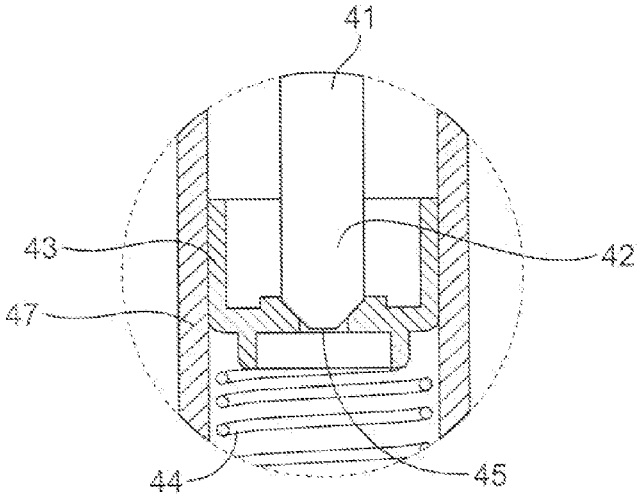
FIG. 5 is an enlarged view of area I of FIG. 2.
Figure 6:
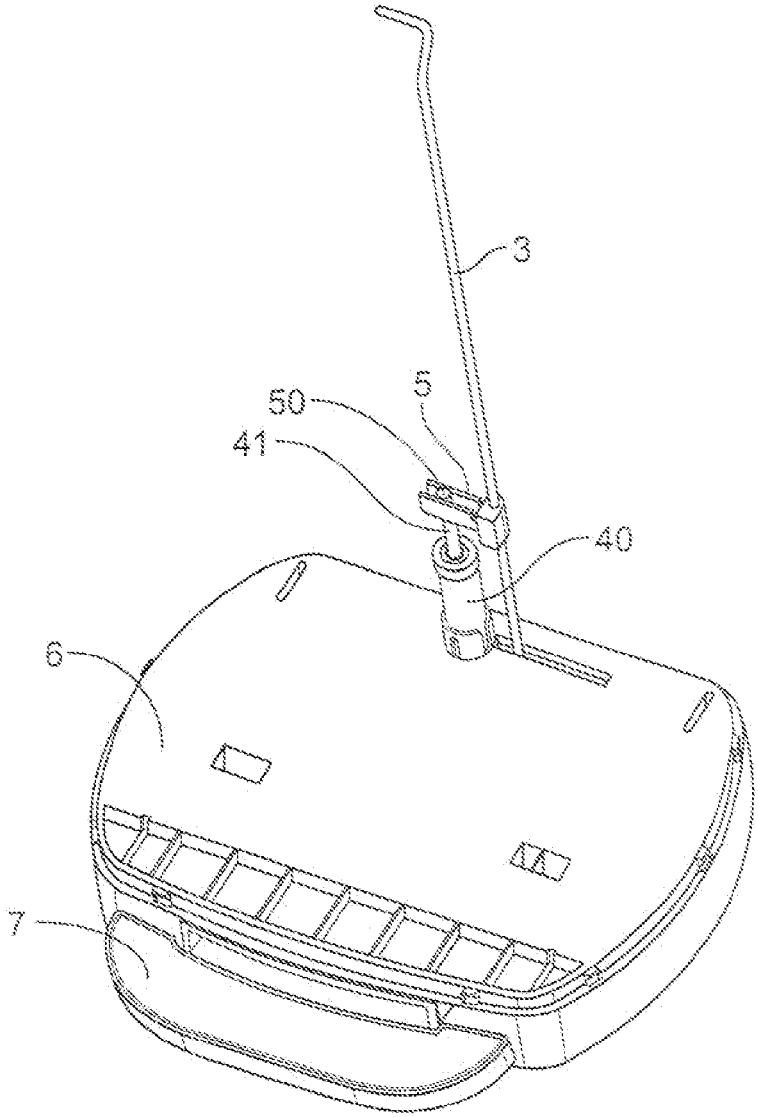
FIG. 6 is an illustration of the installation of the drop-deceleration mechanism of the utility model.
Figure 7:
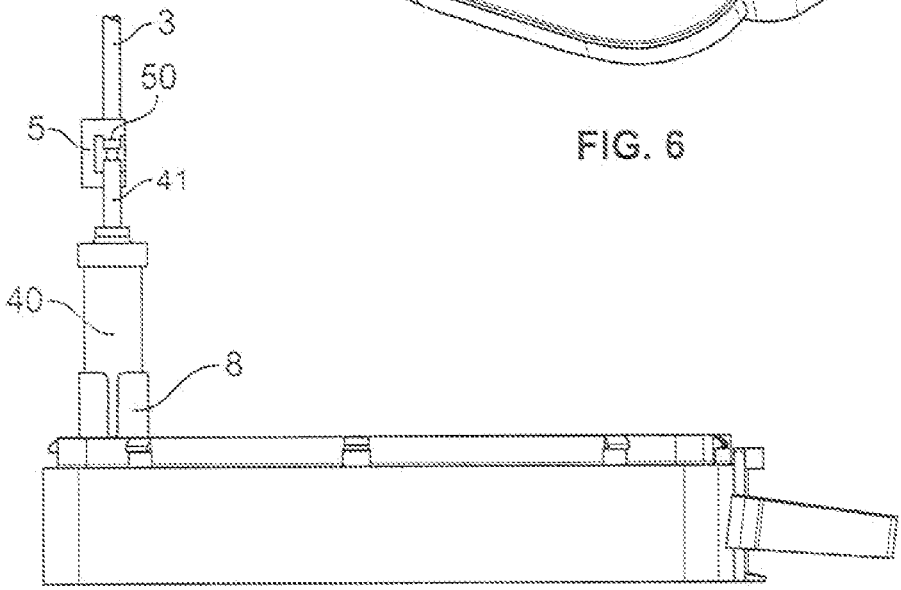
FIG. 7 is another illustration of the installation of the drop-deceleration mechanism of the utility model.

Referring to FIG. 5, furthermore, for outstanding implementation, the aforementioned drop-deceleration flow-guiding mechanism is created by a space between the piston 43 and the cylinder 40. The size of that space controls the amount of the hydraulic fluid flow; and the amount of the hydraulic fluid flow controls the speed of the piston. As a result, deceleration of the drop of trash can lid is achieved.

Furthermore, the tip 42 of said guiding rod 41 is enclosed within, and is connected movably thereto, the interior chamber of the cylinder.

For outstanding implementation, the cylinder 40 consists of the cylinder cap 46 and the cylinder body 47; the connection between the cylinder cap 46 and the cylinder body 47 is sealed by a gasket 48.

Furthermore, a hole is placed in the cylinder cap 46. The tip 42 of the aforementioned gliding rod 41 is connected movably to the interior of the cylinder. The hole between the gliding rod 41 and the cylinder cap 46 is sealed by the gasket 49.

For outstanding implementation, the aforementioned rise-acceleration flow-guiding hole 45 is V-shaped. The tip 42 of the gliding rod 41 is correspondingly V-shaped, which results in a better fit.

To prevent the gliding rod 41 from slipping out, an rise-limitation stopper 420 can be placed in an area of the gliding rod 41 which is housed within the chamber of the cylinder. A limitation cushion (430) is placed at the top of the interior of the cylinder.

Furthermore, because the push-open connection pole 3 would sway from side to side as well as back and forth when it is in operation, the external connecting tip of said gliding rod 41 is connected to the push-open connection pole 3 through the connector piece 5. The push-open connection pole 3 is secured to one end of the connector piece 5. On the other end is placed a locking groove 50. The gliding rod 41 is installed movably to the locking groove 50 through the locking ring 400 at the upper tip of the gliding rod 41.

This utility model trash works in the following way: When the trash can needs to be opened, the lid is flipped open by hand or by foot. At this time, the gliding rod 41 of the push-open connection pole 3 rises up and the piston 43 moves upward due to the force of the resetting spring 44. Because the upward movement of the gliding rod 41 is faster than the upward movement of the piston 43 powered by the resetting spring 44, the rise-acceleration flow-guiding hole 45 opens up during the lid opening process. As result, the hydraulic fluid in the upper chamber rapidly into the lower chamber. The fast opening of the lid is thus realized. On the other hand, when the lid needs to be closed, the lid is to be returned to a certain angle and the push-open connection pole 3 goes down under the weight of the lid. At this time, the tip 42 of the gliding rod 41, which is connected to the push-open connection pole 3, closes the rise-acceleration flow-guiding hole 45; the hydraulic fluid in the lower chamber can only go into the upper chamber through the space between the piston 43 and the interior wall of the cylinder 40 slowly. Thus, the gliding rod 41 moves downward slowly and the push-open connection pole also could only move downward slowly. As a result, the lid closes slowly and noise generated by the lid hitting against the can is avoided, which are desirable effects of the operation.

Besides the above described implantation, of course, other similar applications of this utility model naturally come within the scope being protected.

The preferred embodiment also uses a foot pedal that is connected to a lever arm mechanism which raises a pole when the foot pedal is depressed. When the foot pedal is released, the pole descends. When the lid is connected to the pole, the action of the foot pedal opens and closes the lid. When a user depresses the foot pedal, the lid opens, and when a user releases the foot pedal, the lid closes. FIGS. 2-5 show the piston 43 moving relative to the cylinder body 47 and having flow control by a rise acceleration flow guiding hole 45 restricted by a tip 42 of the gliding rod 41. The rise limitation stopper 420 is formed as an annular protrusion on the gliding rod 41 and coming into contact with limitation cushion 430. Thus, the rebounding spring 44 rises quickly and falls slowly. FIGS. 11-12 show the tip 42 seating on the rise acceleration flow guiding hole 45. FIG. 11 shows the spring expending, and FIG. 12 shows the spring being compressed. It is desired to have slow compression and fast expansion of the spring to facilitate gentle closing of the lid of the apparatus.

Figure 8:
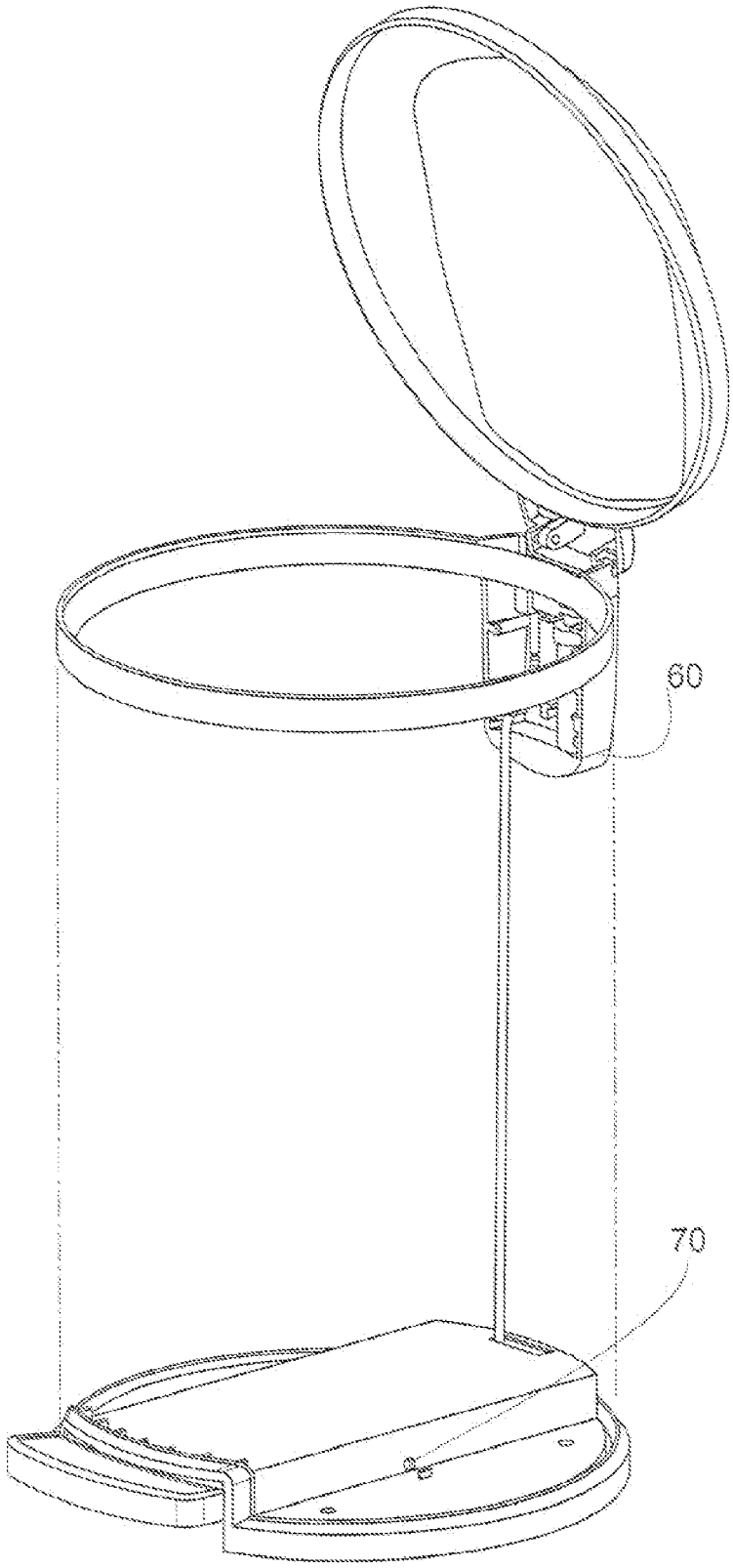
FIG. 8 is a diagram of the preferred embodiment.
Figure 9:
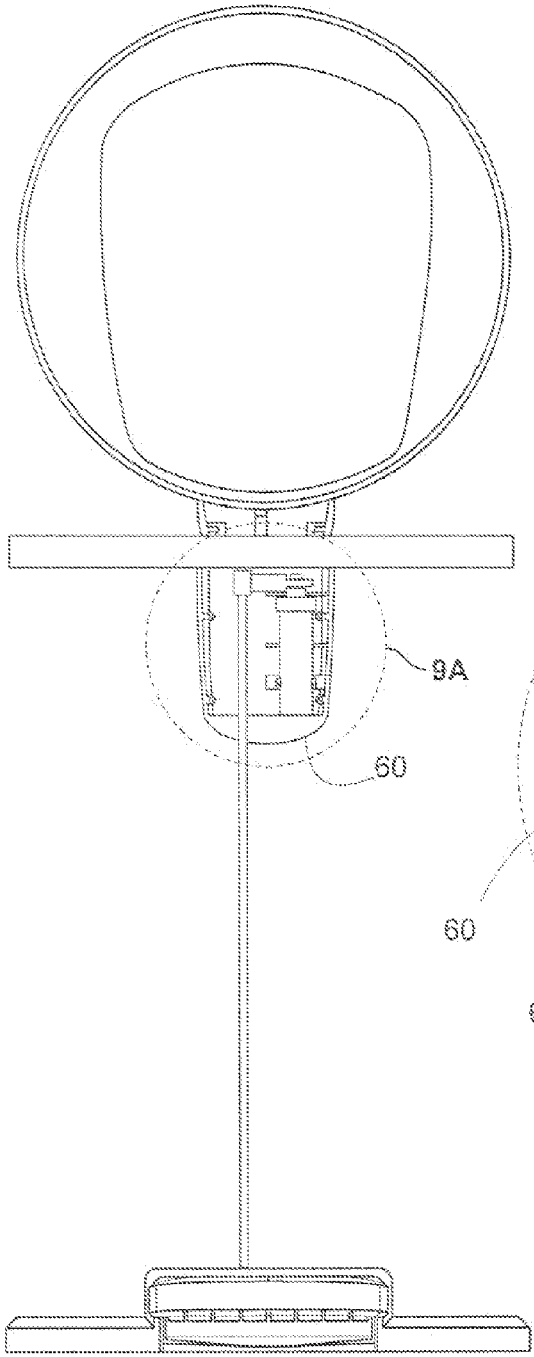
FIG. 9 is a diagram of the mechanical portion of the preferred embodiment.
Figure 9A:
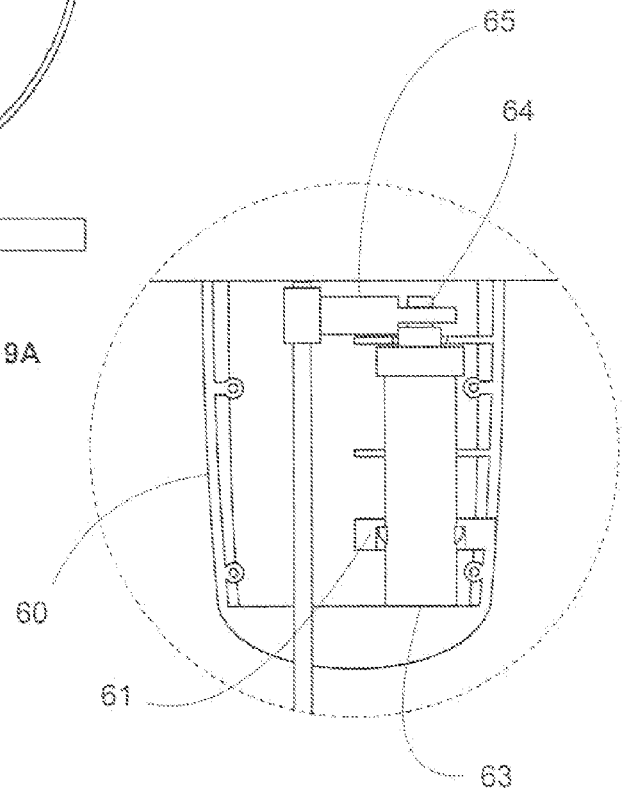
FIG. 9A is a zoom view of the piston assembly portion.
Figure 10A:
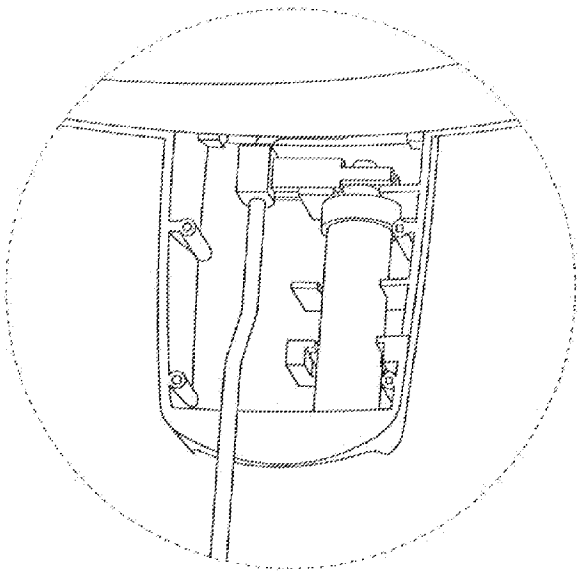
FIG. 10A is a zoom view of the piston assembly portion.
Figure 10:
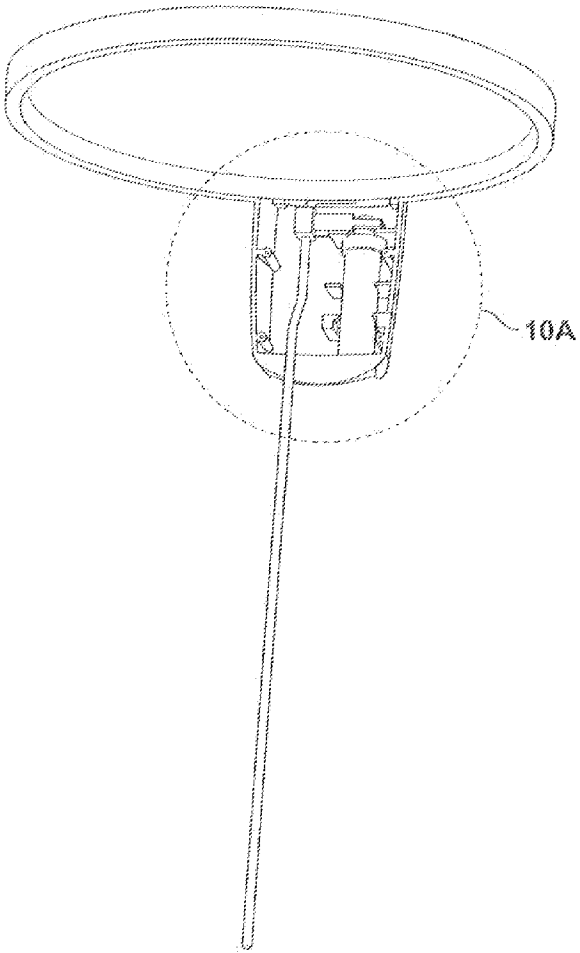
FIG. 10 is a diagram of the preferred embodiment.

FIG. 8 provides a perspective view of the preferred embodiment. In the preferred embodiment, a pivot axle 70 provides a fulcrum for the lever mechanism. The lever mechanism extends from the front at the pedal to the rear at the pole. Thus, when a user steps on the panel, the pole moves. By adjusting the location of the pivot axle 70, the mechanical advantage can be selected and adjusted. Pivot axle 70 can be constructed of a metal cylindrical rod passing under a plastic injection molded, or bent metal lever. The lever can be disposed as a flat planar member connecting to a user foot on a front end and connecting to the pole at a rear end.

The preferred embodiment has a hydraulic mechanism housing 60. The hydraulic mechanism housing 60 is attached to an external surface of the trashcan and has a plurality of support rib 61 for retaining the cylinder body 47 within the hydraulic mechanism housing 60. The hydraulic mechanism housing 60 can be made of plastic injection molding and having four screw holes for screwing onto a metal trashcan body near and upper edge of the trashcan body. The hydraulic mechanism housing 60 can be secured or integrally formed with a top ring that fits over the top edge of the metal trashcan body. The hydraulic mechanism housing is preferably located at a top edge of the metal trashcan body, but could also be located at the bottom portion of the metal trashcan body.

The hydraulic mechanism housing 60 further has support abutment 63 where the housing 60 abuts a lower base portion of the cylinder body 47. The support abutment 63 forms a shelf on which the cylinder body 47 sits. A parallel linkage 65 links the connection pole 3 to the locking ring 400 at the hydraulic connection 64 so that the vertical motion of the connection pole 3 is rigidly translated to the locking ring 400 of the hydraulic connection 64. The gliding rod 41 has an upper end connecting to the hydraulic connection 64 at a locking ring 400.

In the preferred embodiment, the foot pedal 7 remains in the same location at the bottom front of the apparatus so that when a user presses the foot pedal, the connection pole 3 is raised. The connector piece 5 formed as a U-shaped clip member can be adjusted, and the parallel linkage 65 can be formed as a plastic connector that has a pair of forked tines, each extending around the locking ring 400. The locking ring is formed as a circumferential groove on the gliding rod 41.

The invention claimed is:

1. A trashcan with a hydraulic drop-deceleration mechanism comprising:

a. a can body;

b. a lid installed on top of the can body;

c. a connection pole for push-open connection, wherein the lid is connected to the connection pole at a top connection pole end;

d. a foot pedal, wherein the connection pole is connected to the foot pedal via a lever at a bottom connection pole end;

e. a hydraulic mechanism for drop-deceleration, wherein the hydraulic mechanism is connected to the connection pole by a connector; wherein the hydraulic mechanism has a chamber filled with hydraulic fluid, wherein the hydraulic mechanism further comprises a gliding rod moving within the chamber, wherein the gliding rod forms a tip at a gliding rod lower end and wherein the gliding rod connects to the connection pole at a gliding rod upper end, further comprising upper and lower fluid storage chambers; further comprising a piston slidingly mounted in the hydraulic mechanism and biased in a lid open position by a spring, wherein the tip seats on a fluid aperture on the piston in a closed position, wherein when the gliding rod moves up, the tip is removed from the fluid aperture in an open position allowing hydraulic fluid to flow between the lower chamber and the upper chamber, and wherein when the gliding rod glides downward, the tip closes the fluid aperture, and slows hydraulic fluid flow between the lower chamber and the upper chamber.

2. The trashcan of claim 1, wherein the drop-deceleration flow-guiding mechanism is formed by a space between the piston and an interior surface of a cylinder of the hydraulic mechanism.

3. The trashcan of claim 1, wherein the tip is enclosed within, and is connected movably to an interior chamber of a cylinder of the hydraulic mechanism.

4. The trashcan of claim 1, wherein a cylinder has a cylinder cap and a cylinder body; wherein a connection between the cylinder cap and the cylinder body is sealed by a gasket.

5. The trashcan of claim 1, wherein a hole is disposed in a cylinder cap, and the tip is connected movably to the interior of a cylinder which houses the cylinder cap, wherein the hole between the gliding rod and the cylinder cap is sealed by a gasket.

6. The trashcan of claim 1, wherein the connector is a separate piece which has a first end securing to the connection pole and a second end forming a locking groove, wherein the locking groove receives an upper end of the gliding rod.

7. The trashcan of claim 6, wherein the second end of the gliding rod is an upper end of the gliding rod and it is formed as a locking ring which locks in the locking groove.

8. The trashcan of claim 1, wherein the fluid aperture has a V-shaped cross-section, and the tip is correspondingly V-shaped.

9. The trashcan of claim 1, further comprising a rise-limitation stopper placed on an area of the gliding rod which is housed within a chamber of the cylinder, wherein the rise-limitation stopper is in the chamber.

10. The trashcan of claim 9, further comprising a limitation cushion placed at a top of an interior of the cylinder.

11. The trashcan of claim 1, further comprising a hydraulic mechanism housing, wherein the hydraulic mechanism is mounted within the hydraulic mechanism housing, wherein the hydraulic mechanism housing is mounted to a top portion of the can body.

12. The trashcan of claim 11, wherein the drop-deceleration flow-guiding mechanism is formed by a space between the piston and an interior surface of a cylinder of the hydraulic mechanism.

13. The trashcan of claim 11, wherein the tip is enclosed within, and is connected movably to an interior chamber of a cylinder of the hydraulic mechanism.

14. The trashcan of claim 11, wherein a cylinder has a cylinder cap and a cylinder body; wherein a connection between the cylinder cap and the cylinder body is sealed by a gasket.

15. The trashcan of claim 11, wherein a hole is disposed in a cylinder cap, and the tip is connected movably to the interior of a cylinder which houses the cylinder cap, wherein the hole between the gliding rod and the cylinder cap is sealed by a gasket.

16. The trashcan of claim 11, wherein the connector is a separate piece which has a first end securing to the connection pole and a second end forming a locking groove, wherein the locking groove receives an upper end of the gliding rod.

17. The trashcan of claim 16, wherein the second end of the gliding rod is an upper end of the gliding rod and it is formed as a locking ring which locks in the locking groove.

18. The trashcan of claim 11, wherein the fluid aperture has a V-shaped cross-section, and the tip is correspondingly V-shaped.

19. The trashcan of claim 11, further comprising a rise-limitation stopper placed on an area of the gliding rod which is housed within a chamber of the cylinder, wherein the rise-limitation stopper is in the chamber.

20. The trashcan of claim 19, further comprising a limitation cushion placed at a top of an interior of the cylinder.

* * * * *